United States Patent [19]

Gessinger et al.

[11] 4,410,488

[45] Oct. 18, 1983

[54] POWDER METALLURGICAL PROCESS FOR PRODUCING A COPPER-BASED SHAPE-MEMORY ALLOY

[75] Inventors: Gernot Gessinger, Birmenstorf; Oliver Mercier, Ennetbaden; Helmut Riegger, Busslingen, all of Switzerland

[73] Assignee: BBC Aktiengesellschaft Brown, Boveri & Cie, Baden, Switzerland

[21] Appl. No.: 286,865

[22] Filed: Jul. 27, 1981

[30] Foreign Application Priority Data

Aug. 7, 1980 [CH] Switzerland ..... 5986/80

[51] Int. Cl.[3] ..... B26D 5/20; C21D 8/00

[52] U.S. Cl. ..... 419/48; 148/11.5 C; 148/11.5 P

[58] Field of Search ..... 148/11.5 P, 11.5 C, 148/11.5 P; 75/226, 214

[56] References Cited

U.S. PATENT DOCUMENTS

| | | | |
|---|---|---|---|
| 3,700,434 | 10/1972 | Abkowitz et al. | 75/214 |
| 3,775,101 | 11/1973 | Freche et al. | 75/214 |
| 4,094,053 | 6/1978 | Weaver | 75/214 |
| 4,140,528 | 2/1979 | Hebeisen et al. | 75/246 |

FOREIGN PATENT DOCUMENTS 1346047 2/1974 United Kingdom .

OTHER PUBLICATIONS

Lenel, *Powder Metallurgy,* N.J., Metal Powder Industries Federation, 1980, pp. 143–153.

Goetzel, *Treatise on Powder Metallurgy,* V. 2, Interscience Publishers Inc., N.Y., 1950, pp. 643–646 & 658–666.

*Primary Examiner*—Brooks H. Hunt

*Assistant Examiner*—Anne Brookes

*Attorney, Agent, or Firm*—Oblon, Fisher, Spivak, McClelland & Maier

[57] ABSTRACT

Shape-memory alloys comprised of Cu/Al or Cu-/Al/Ni are produced by a powder metallurgical process wherein a coarse-grained powder of pre-alloyed and/or pre-mixed powder alloys having a grain size of 0.05 to 0.8 mm is introduced into a metal container which is then evacuated, sealed, and hot isostatically pressed. The resulting billet is then hot worked. In another embodiment, the powder is first placed in a rubber tube and cold isostatically pressed. The billet is then placed in a cylinder having deformable walls, such as a copper cylinder, the cylinder is sealed, and the powder therein is then hot isostatically pressed, and the billet so prepared is subjected to a homogenization heat treatment and hot working.

8 Claims, 2 Drawing Figures

POWDER METALLURGICAL PROCESS FOR PRODUCING A COPPER-BASED SHAPE-MEMORY ALLOY

BACKGROUND OF THE INVENTION

1. Field of the Invention

This invention relates to a process for producing a copper-based shape-memory alloy, and more particularly to a process for producing such a memory alloy by powder metallurgy.

2. Description of the Prior Art

Shape-memory alloys of the high strength $\beta$-brass type have been hitherto produced chiefly by melt metallurgical processes. Powder-metallurgical methods of producing these alloys have also been developed and have been disclosed by, for example, M. Follom and E. Aernoudt, "Powder-metallurgically processed shape-memory alloys", 5th European Symposium on Powder Metallurgy, Stockholm, 1978, pages 275–281. These methods, which employ for the most part fine or very fine powders, are well known in powder metallurgy. On the other hand, some powder metallurgical production methods are also known which use relatively coarse-grained powder as the raw material. These methods are primarily used for the powder metallurgy of titanium alloys and nickel superalloys (e.g., G. H. Gessinger, Brown Boveri Research Center, "Titanium powder metallurgy and composites", International Titanium Conference, Kyoto, May 1980; G. H. Gessinger and M. J. Bomford, "Powder metallurgy of superalloys", International Metallurgical Reviews, 1974, Volume 19, pages 51–76).

If the customary powder metallurgical methods, i.e., mixing, pressing and sintering (possibly with repeated alternate pressing and sintering) are used to produce articles from coarse powders of copper alloys, the densest structures which can be obtained are porous structures resembling filters, which have long been commercially available for special purposes.

Therefore, a need has continued to exist for a method for producing compact, dense copper-alloy articles.

SUMMARY OF THE INVENTION

Accordingly, it is an object of the invention to provide a method for preparing copper-based shape-memory alloys.

A further object is to provide a method for producing copper-based shape-memory alloys which is highly reproducible.

A further object is to provide a simple and economical method for preparing copper-based shape-memory alloys.

A further object is to provide a method for preparing copper-based shape-memory alloys which is suitable for mass production.

A further object is to provide a method for preparing homogenous, compact products of copper-based shape-memory alloys, which are in the form of semifinished or finished goods.

Further objects of the invention will be apparent from the description which follows.

These and other objects of the invention are achieved by a process for producing a copper-based shape-memory alloy by powder metallurgy comprising:

providing a coarse-grained copper alloy powder having a particle size of 0.05 to 0.8 mm diameter, placing said powder into a container, evacuating said container, sealing said container, hot isostatically pressing said powder mixture in said container at a pressure of 50 to 300 MPa in a temperature range of 750°to 950° C. for ½ to 5 hours, whereby a billet is prepared, and subjecting said billet to a hot working operation at a temperature of 750° to 850° C.

A more complete appreciation of the invention and many of the attendant advantages thereof will be readily obtained is the same becomes better understood by reference to the following detailed description when considered in connection with the accompanying drawings, wherein.

DETAILED DESCRIPTION OF THE INVENTION AND PREFERRED EMBODIMENTS

The coarse powders (grain size greater than 0.05 mm) used in the process of this invention can be produced by plasma spheroidization, by the rotating electrode method, by atomization of a melt by means of ultrasonic agitation, by atomization by high-speed spraying, or by any other known method.

The metal powder used as the raw material in the process of this invention as may be comprised of particles of alloy having the same composition as the finished product, or it may comprise powders having various compositions which, taken together, will produce a finished product having the alloy composition. The grain size (particle diameter) of the powder can range between 0.05 and 0.8 mm. The pressure applied during isostatic pressing can range from 50 to 300 MPa depending on the conditions and size of the billet being produced; the corresponding temperature of pressing can range from 750° to 950° C. depending on the alloy, and the duration of the pressing can be ½ hour to 5 hours. The subsequent hot working step can be carried out by forging, pressing, swaging, rolling, and the like, and is advantageously carried out in a temperature range between 750° and 850° C. In carrying out the isostatic pressing operation, the powder may be encapsulated in a suitable container such as a hollow cylinder of stainless steel, copper, or a ductile copper alloy. Ordinarily, the powder is placed into a cylinder, and the capsule is evacuated, covered with a lid, and sealed by welding or soldering.

Figure 1:
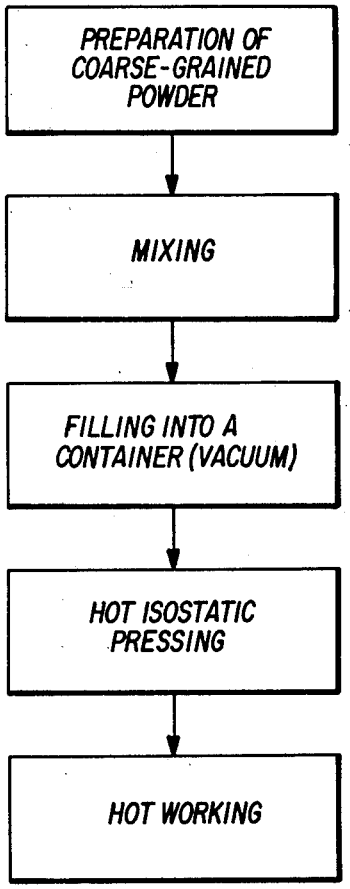
FIG. 1 shows a flow chart of the basic process steps.

This general process of the invention is illustrated in the flow chart of FIG. 1.

Figure 2:
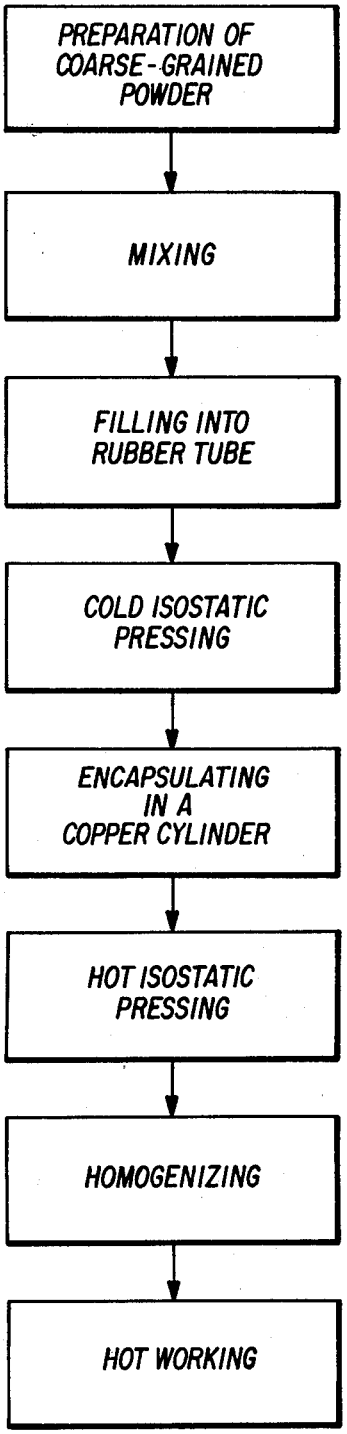
FIG. 2 shows a flow chart of an alternative embodiment of the process of the invention incorporating additional steps of cold isostatic pressing and homogenization.

In another embodiment of the invention, illustrated by the flow chart of FIG. 2, the coarse-grained powder is introduced into a container of rubber or plastic and subjected to cold isostatic pressing to compact the powder. The cold isostatic pressing can be carried out at pressures of 300 to 800 MPa for a period of 1 to 10 minutes. Subsequently, the compact is removed from the rubber or plastic container, introduced into a deformable thin-walled metallic cylinder, such as a copper cylinder, the cylinder is evacuated and sealed, and the sealed capsule is then subjected to hot isostatic pressing under the conditions described above. After the pressing step the billet is heat treated to provide a homogenization annealing in the temperature range of 900° to 950° for 1 to 20 hours. Following the annealing, the billet is subjected to hot working as described above.

Alloys particularly suited for use with this method are those having the following composition:

Aluminum: 10.5 to 15% by weight
Nickel: 0 to 6% by weight
Copper: Balance

Articles of a shape-memory alloy of the Cu/Al or Cu/Al/Ni type produced by the powder metallurgical method of this invention have a better homogeneity than articles produced by melt metallurgical or conventional powder metallurgical methods. The process of this invention also permits more economical production of articles made from a shape-memory alloy of this type.

Having generally described the invention, a more complete understanding can be obtained by reference to certain specific examples, which are provided herein for purposes of illustration and are not intending to be limiting unless otherwise specified.

EXAMPLE 1

This example illustrates the embodiment of the invention shown in FIG. 1.

A coarse-grained alloy powder was produced by the rotating electrode method. The alloy had the following composition and particle size:

Aluminum: 13% by weight
Nickel: 3% by weight
Copper: 84% by weight
Particle diameter: 0.2–0.5 mm A sample of the coarse-grained powder amounting to 1500 g was mixed and poured under vacuum into a metal container. In this example the container was a thin-walled hollow cylinder of stainless steel having the following dimensions:

Interior diameter: 97 mm
Height: 150 mm
Wall thickness: 1.5 mm

A cover was placed on the steel cylinder and the container was welded shut under vacuum. The capsule thus filled with powder was subjected to hot isostatic pressing under the following conditions:

Isostatic (hydrostatic) pressure: 50 MPa
Temperature: 850° C.
Structure of the powder (phase structure): $\beta$-mixed crystal
Duration of hot pressing: 1 hour After pressing, the billet was hot worked by free form forging at a temperature of about 800° C. The diameter of the workpiece was reduced so that the resulting billet was a bar 18 mm in diameter.

EXAMPLE 2

This example illustrates the embodiment of the invention shown in FIG. 2.

Two coarse-grained pre-alloy powders were produced by the rotating electrode method. The powders had the following composition and particle size:

Powder I

Aluminum: 10% by weight
Copper: 90% by weight
Particle diameter: 0.2–0.8 mm
Amount: 500 g

Powder II

Aluminum: 12% by weight
Nickel: 8% by weight
Copper: 80% by weight
Particle diameter: 0.2–0.8 mm
Amount: 500 g Samples of each powder amounting to 500 g were mixed and 800 g of the mixture were poured under vacuum into a rubber tube 88 mm in interior diameter and 110 mm in length. The powder mixture corresponded to an alloy of the following ultimate composition:

Aluminum: 11% by weight
Nickel: 4% by weight
Copper: 85% by weight

The powder encapsulated in the rubber tube was subjected to cold isostatic pressing under the following conditions:

Isostatic pressure: 800 MPa
Duration of pressing: 1 minute
The cold pressed billet was removed from the rubber tube and encapsulated in a copper cylinder having the following dimensions:

Interior diameter: 83.5 mm
Height: 100 mm
Wall thickness: 0.75 mm

The copper cylinder was provided with a lid and was welded shut under vacuum. The sealed capsule was then subjected to hot isostatic pressing under the following conditions.

Isostatic pressure: 100 MPa
Temperature: 750° C.
Structure of Powder (phase structure): $\beta$-mixed crystal
Duration of pressing: 1 hour After pressing, the billet was given a thermal treatment to effect a homogenization annealing under the following conditions:

Temperature: 950° C.
Duration: 1 hour
Protective gas: Argon

After homogenization, the billet was forged by a procedure similar to that of Example 1.

Having now fully described the invention, it will be apparent to all of ordinary skill in the art that many changes and modifications can be made thereto without departing from the spirit or the scope of the invention as set forth herein.

We claim:

1. A process for producing a copper-based shape memory alloy by powder metallurgy, comprising:

providing a coarse-grained alloy powder having a particle size of 0.2 to 0.8 mm grain diameter;

introducing said powder into a container; evacuating said container;

sealing said container under vacuum;

hot isostatically pressing said powder at a pressure of 50 to 300 MPa in a temperature range from 750° to 950° C. for 1/5 to 5 hours, whereby a billet is formed; and subjecting said billet to hot working at a temperature of 750° to 850° C.

2. The process of claim 1 wherein said hot working operation is selected from the group consisting of forging, pressing, swaging, and rolling.

3. The process of claim 1 wherein an alloy powder having a composition the same as the final composition of the memory alloy is used as the raw material.

4. The process of claim 1 wherein 2 or more pre-alloy powders are used as the raw material.

5. The process of claim 1 wherein said container is made from a metal selected from the group consisting of stainless steel and copper.

6. The process of claim 1 comprising the additional preliminary step of introducing the alloy powder into a rubber or plastic tube and subjecting the powder to a cold isostatic pressing at a pressure of 300 to 800 MPa for 1 to 10 minutes.

7. The process of claim 1 or claim 6 wherein said billet is subjected to a homogenization annealing in a protective gas atmosphere at a temperature of 900° to 950° C. for 1 to 20 hours after said hot isostatic pressing and before said working operation.

8. The process of claim 1 wherein the alloy powder used as raw material has a composition corresponding to a shape-memory alloy having the following composition:

aluminum: 10.5 to 15% by weight nickel: 0 to 6% by weight copper: balance.

* * * * *